US009417566B2

(12) United States Patent
Shibuya

(10) Patent No.: US 9,417,566 B2
(45) Date of Patent: Aug. 16, 2016

(54) IMAGE FORMING APPARATUS AND SYSTEM OPERABLE IN GHOST-SUPPRESSION MODE

(71) Applicant: CANON KABUSHIKI KAISHA, Tokyo (JP)

(72) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/802,054

(22) Filed: Jul. 17, 2015

(65) Prior Publication Data

US 2016/0018763 A1 Jan. 21, 2016

(30) Foreign Application Priority Data

Jul. 18, 2014 (JP) ..... 2014-148282

(51) Int. Cl.
*G03G 15/16* (2006.01)

(52) U.S. Cl.
CPC ..... *G03G 15/1615* (2013.01)

(58) Field of Classification Search
CPC ..... G03G 15/1675; G03G 15/5054
See application file for complete search history.

(56) References Cited

U.S. PATENT DOCUMENTS 6,738,588 B2 5/2004 Yokomori et al.
8,526,835 B2 * 9/2013 Lee ..... G03G 15/0131 399/39
2010/0303492 A1 * 12/2010 Furukawa ..... G03G 15/0131 399/55
2010/0329702 A1 * 12/2010 DiRubio ..... G03G 15/1675 399/27

FOREIGN PATENT DOCUMENTS

JP 2002-189400 A 7/2002

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes a first toner image forming unit including a rotatable photosensitive drum and a charger and configured to form a first toner image on the drum, the charger being supplied with a DC voltage to charge; a movable intermediary transfer member supplied with a transferring current for transferring the first image from the drum onto the transfer member, the transfer member carrying a second toner image at a position upstream of the transfer portion; and a switching portion for switching a mode from a first mode in which a maximum toner deposition amount of the second image fed to the transfer portion and a transfer current supplied to the transfer member are set at respective standard levels to a second mode in which the toner deposition amount and the transferring current are set at respective predetermined levels which are different from the standard levels.

6 Claims, 11 Drawing Sheets

IMAGE FORMING APPARATUS AND SYSTEM OPERABLE IN GHOST-SUPPRESSION MODE

FIELD OF THE INVENTION AND RELATED ART

The present invention relates to an image forming apparatus which uses an electrophotographic image forming method, and also, an image formation system comprising an image forming apparatus, and a controlling device (control section) which is driven by a printer driver in an information processing peripheral device (apparatus).

In recent years, electrophotographic image forming apparatuses which are capable of forming multicolor images or full-color images, have come into general use. Regarding the configuration of a color image forming apparatus, there is an image forming apparatus of the so-called tandem type. In the case of an image forming apparatus of the tandem type, multiple photosensitive members which are different in the color of the image to be formed thereon, are aligned in tandem, and multiple toner images, different in color, formed on the peripheral surfaces of the photosensitive drums are sequentially layered upon an intermediary transferring member, or a sheet of recording medium borne by a recording medium bearing member.

As a method for charging the photosensitive drums of an electrophotographic image forming apparatus, a charging method which charges an electrophotographic photosensitive member by placing a charging member in contact with, or in the adjacencies of, the peripheral surface of the photosensitive member, and applying electrical voltage to the charging member, has come into wide use, because of its merits that this charging method makes it possible to reduce in voltage the electrical power source for the charging device, and also, is relatively small in the amount of ozone generation. Among various charging methods which are basically the same as the above described charging method, the so-called "DC charging method" which applies only DC voltage to the charging member to charge a photosensitive member, is advantageous in terms of operational cost as well as initial cost, compared to the so-called "AC charging method" which applies a combination of DC and AC voltages to the charging member to charge a photosensitive member, for the following reason. That is, "DC charging method" is small in the amount of electrical discharge between a charging member and a photosensitive member, and therefore, is smaller in the amount by which the peripheral surface of the photosensitive member is shaved, than the "AC charging method". Thus, "DC charging method" can contribute to extending a photosensitive member in service life. Further, the former is advantageous over the latter, in that the former does not require an AC power source.

However, "DC charging method" is inferior to "AC charging method" in terms of the uniformity in the electrical charge of the peripheral surface of the photosensitive member, because, unlike the AC charging method, "DC charging method" cannot make the peripheral surface of a photosensitive member uniform in potential. More concretely, the so-called "transfer ghost" is more likely to occur when "DC charging method" is used, than when the "AC charging method" is used. "Transfer ghost" is such a phenomenon that as a photosensitive member is rotated, the portions of the peripheral surface of the photosensitive member, which did not have toner when they are in the transferring section, become different in surface potential level from the portions of the peripheral surface of the photosensitive member, which had toner when they are in the transferring section, after the transfer of the toner in the transferring section. This nonuniformity in surface potential level is not eliminated in the charging section; that is, the peripheral surface of the photosensitive member remains nonuniform in potential level even after it is charged by the charging member. In other words, even after the charging of the photosensitive member, the photosensitive member remains nonuniform in potential level. Consequently, images, which suffer from unwanted nonuniformity in density, are outputted.

There is disclosed in Japanese Laid-open Patent Application 2002-189400 a technology for preventing the occurrence of the transfer ghost. According to this patent application, after the transfer process, the peripheral surface of a photosensitive member is exposed to light by a pre-exposing device to reduce the surface potential level of the photosensitive member to virtually 0 V, that is, to make the peripheral surface of the photosensitive member virtually uniform in potential level at roughly 0 V, in order to minimize the peripheral surface of the photosensitive member in nonuniformity in terms of potential level. A transfer ghost is more conspicuous in a case where a certain area of the peripheral surface of a photosensitive member is greater in the amount of toner than the other area, since toner functions as electrical resistor in the transferring section. For example, in the case of an image forming apparatus of the tandem-type, a transfer ghost which is generated in the downstream transferring section, in terms of the direction in which the sheet of recording medium is conveyed, as a toner image of the secondary color, which was formed on a transferring medium in the transferring section of the upstream image forming section, is likely to be conspicuous, in particular, in a case where a toner image of the secondary color is a solid image made up of two toners which are different in color. For example, a solid red image made up of a combination of a yellow monochromatic image and a magenta monochromatic image is likely to generate a transfer ghost in a half-tone area of an image, which is cyan or black in color, and which is formed in the downstream image forming sections.

Here, as described above, the occurrence of a transfer ghost such as the above described one can be prevented by discharging the peripheral surface of a photosensitive member with the use of a charging means such as a pre-exposing device. In such a case, however, not only the charge current necessary to charge the areas of the peripheral surface of the photosensitive member, which did not have toner in the transferring section, increase, but also, the charge current necessary to charge the areas of the peripheral surface of the photosensitive member, which had toner, increases. Consequently, the peripheral surface of a photosensitive member becomes more susceptible to shaving. Thus, this method is likely to reduce a photosensitive member in service life. Further, in order to provide an image forming apparatus with a charging removing means such as a pre-exposing device, a space is necessary between the cleaning section for cleaning the photosensitive member and the charging section, or between the transferring section and charging section. Thus, it is likely that the image forming apparatus has to be increased in size by the amount equal to the size of the space. Moreover, it is likely that the image forming apparatus has to be increased in cast by the amount necessary to provide the apparatus with a charge removing means such as the pre-exposing device.

Therefore, an image forming apparatus which uses a DC charging method, and yet, can prevent the occurrence of a transfer ghost without being provided with a charge removing means such as a pre-exposing device, is desired.

Further, normally, a transfer ghost is likely to occur only under a certain condition such as the above-described ones (certain area of multicolor image has uniform in color and has secondary color). Ordinarily, therefore, image forming apparatuses are not primarily set to prevent the occurrence of a transfer ghost.

SUMMARY OF THE INVENTION

Thus, it is sometimes desired that the setting for preventing the occurrence of a transfer ghost is added to the normal settings for the apparatus. Therefore, it is desired that an image forming apparatus can be simply switched in operational setting to the one for preventing the occurrence of a transfer ghost, as necessary.

Further features of the present invention will become apparent from the following description of exemplary embodiments (with reference to the attached drawings).

DESCRIPTION OF THE EMBODIMENTS

Hereinafter, the image forming apparatuses and image formation systems, which are in accordance with the present invention, are described in detail with reference to the appended drawings.

Embodiment 1

1. Overall Structure and Operation of Image Forming Apparatus

Figure 1:
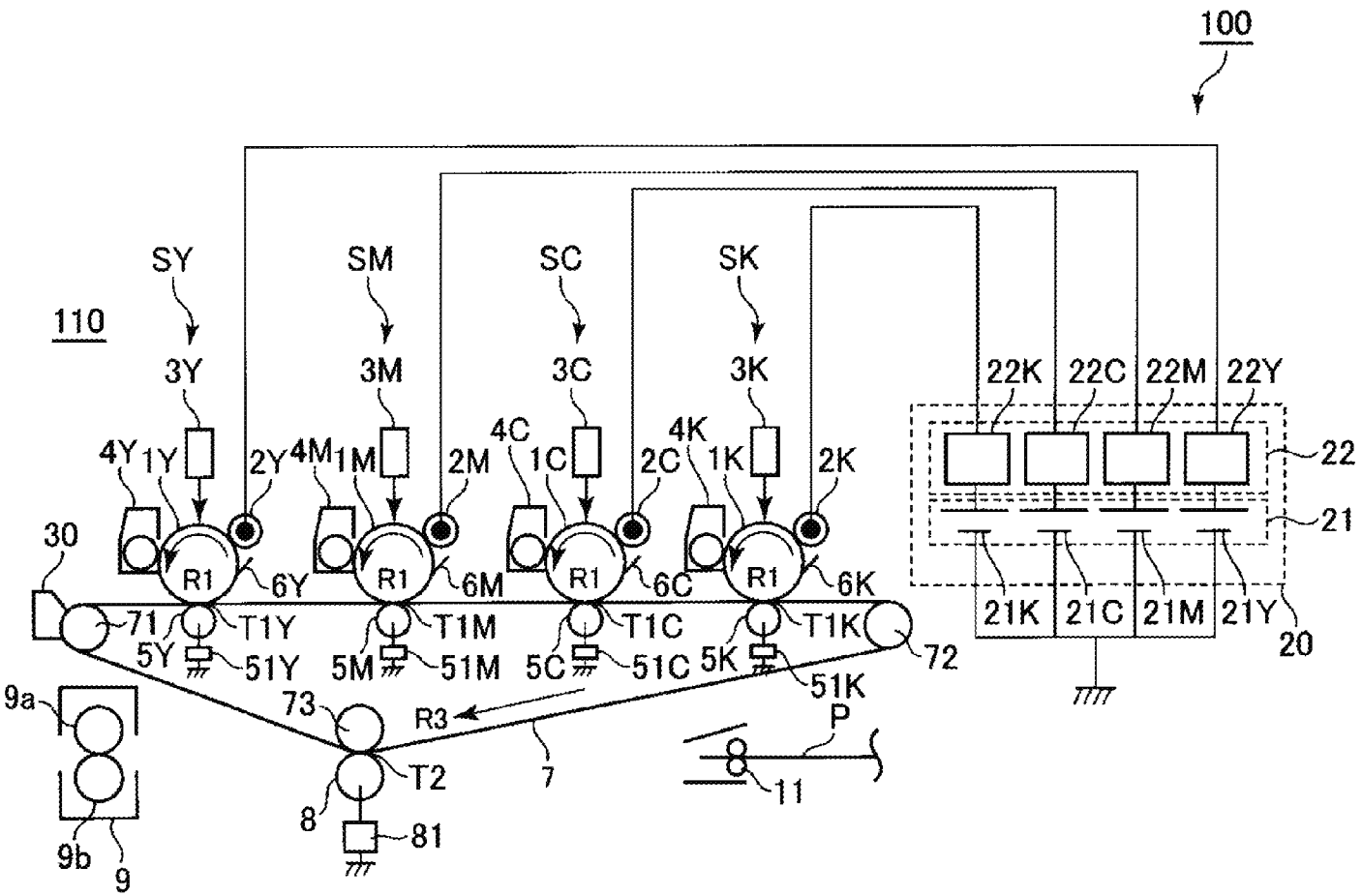
FIG. 1 is a schematic sectional view of the image forming apparatus in the first embodiment of the present invention.

FIG. 1 is a schematic sectional view of the image forming apparatus 100 in the first embodiment of the present invention. The image forming apparatus 100 has multiple image forming sections, more specifically, the first, second, third, and fourth image forming stations SY, SM, SC and SK, which form yellow (Y), magenta (M), cyan (C) and black (K) monochromatic images, respectively. These four stations are aligned with preset intervals.

By the way, in this embodiment, the four stations SY, SM, SC and SK are practically the same in structure and operation, although they are different in the color of the toner they use. Hereafter, therefore, unless they need to be differentiated, they are described together; suffixes Y, M, C and K which indicate the color of the image they form are eliminated. Further, in a case where it is necessary for the first, second, third, and fourth stations, and the components thereof, to be separately described, they may be provided with suffixes "Y", "M", "C" and "K" which correspond to the color of the toner images they form.

The station S has a photosensitive drum 1, as an image bearing member, which is an electrophotographic rotatable photosensitive member (photosensitive member). Further, the station S has the following processing devices, which are disposed in the adjacencies of the peripheral surface of the photosensitive drum 1. The first one is a charge roller 2, as a charging means, which is a charging member in the form of a roller. The second is an exposing device 3 as an exposing means. The next is a developing device 4 as a developing means. The next is a primary transfer roller 5, as a primary transferring means, which is the primary transferring member in the form of a roller. The last one is a drum cleaning device 6 as a means for cleaning the photosensitive drum 1.

The image forming apparatus 100 has also an intermediary transfer belt 7 as an intermediary transferring member, which is in the form of an endless belt. The intermediary transfer belt 7 is disposed so that it opposes the corresponding photosensitive drum 1 in each station S. It is wrapped around a combination of multiple belt supporting rollers, more specifically, a driver roller 71, a tension roller 72, and a belt backing roller 73 (which opposes secondary transfer roller), being thereby suspended (supported), and also, being provided with a preset amount of tension. The abovementioned primary rollers 5 are disposed on the inward side of the loop which the intermediary transfer belt 7 forms, and also, are disposed so that they oppose the corresponding photosensitive drums 1, one for one. Each primary transfer roller 5 is pressed against the corresponding photosensitive drum 1, with the placement of the intermediary transfer belt 7 between itself and the photosensitive drum 1, forming thereby the primary transferring section T1 (primary transfer nip), in which the intermediary transfer belt 7 contacts the photosensitive drum 1. Moreover, on the outward side of the loop which the intermediary transfer belt 7 forms, the secondary transfer roller 8 is disposed, as a secondary transferring means, which is the secondary transferring member which is in the form of a roller. The secondary transfer roller 8 remains pressed toward the belt backup roller 73 with the placement of the intermediary transfer belt 7 between itself and the belt backing roller 73, forming thereby the secondary transferring section T2 (secondary transfer nip) in which the secondary transfer roll contacts the intermediary transfer belt 7. Further, on the outward side of the loop which the intermediary transfer belt 7 forms, the belt cleaning device 30 as a means for cleaning the intermediary transfer belt 7, is disposed so that it opposes the driver roller 71.

Figure 2:
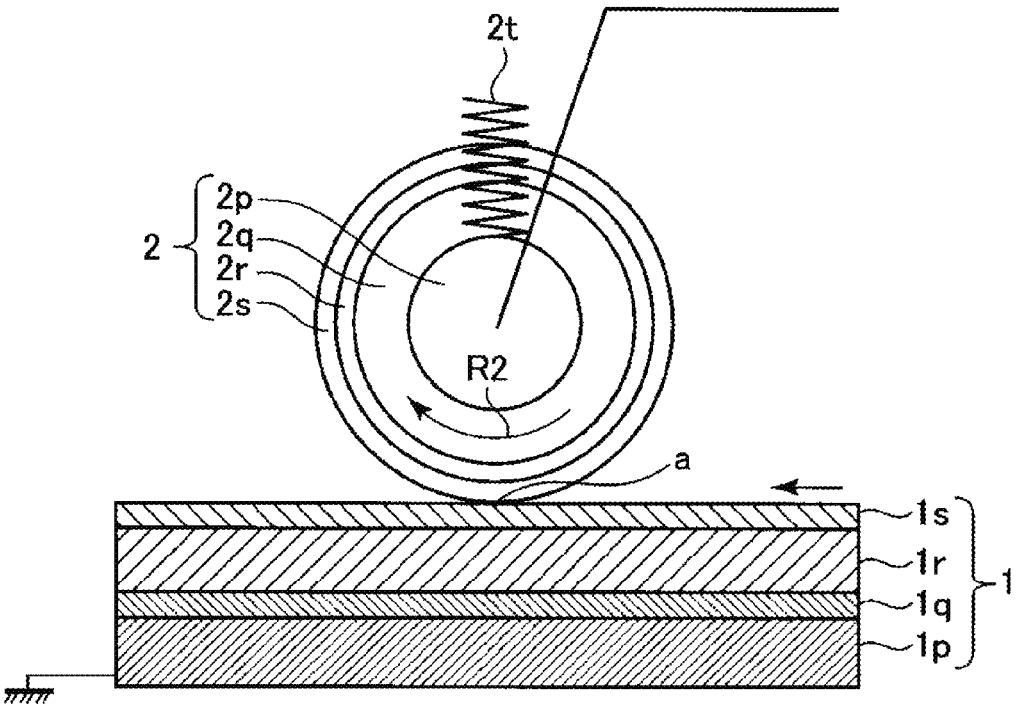
FIG. 2 is a schematic sectional view of a combination of the charge roller and photosensitive drum in the first embodiment, and shows the laminar structure of the charge roller and that of the photosensitive drum.

In this embodiment, the photosensitive drum 1 is 30 mm in diameter, 330 mm in length in terms of the direction parallel to its rotational axis. It is a negatively chargeable organic member (OPC). Referring to FIG. 2, the photosensitive drum 1 comprises: an aluminum cylinder 1*p* (as electrically conductive substrate); an undercoat layer 1*q* which is coated on the peripheral surface of the aluminum cylinder for preventing optical interference and improving the photosensitive drum 1 in terms of adhesion between the aluminum cylinder 1*p* and the layer on the undercoat layer 1*q*; and an optical charge generation layer 1*r* coated on the undercoat layer; a charge transfer layer is coated on the optical charge generation layer 1*r*, listing from the inward side of the photosensitive drum 1. Normally, the photosensitive drum 1 is rotationally driven by a driving device (unshown) at a process speed (peripheral velocity) of 210 mm/sec in the direction indicated by an arrow mark R1 in the drawing.

As the photosensitive drum 1 is rotationally driven, the peripheral surface of the photosensitive drum 1 is uniformly charged by the charge roller 2 to preset a polarity (negative in this embodiment) and a preset potential level. During this process, a charge bias (charge voltage) is applied to the cleaning roller 2 from a charge voltage power source 20 (high voltage power source circuit). The charge voltage power source has a DC voltage generation circuit 21 and a DC voltage amplification circuit 22. In this embodiment, the DC voltage to be applied to the charge roller 2 in each station S is generated by voltage generation circuit 21, with which each station S is provided. The amount of the DC voltage to be applied to the cleaning roller 22 of each station S is adjusted by the DC voltage amplification circuit 22, with which each station S is provided. In this embodiment, a DC charging method is employed as the method for charging the photosensitive drum 1, as described above. In this embodiment, the charge bias is −1300 V of DC voltage, and a potential level Vd of an unexposed point of the peripheral surface of the photosensitive drum 1 is −700 V in the developing position.

In this embodiment, the cleaning roller 2 is 230 mm in length in terms of the direction parallel to the axial line of the cleaning roller 2. Referring to FIG. 2, the cleaning roller 2 comprises: a metallic core 2*p* (supporting member) and three layers, more specifically, an undercoat layer 2*q*, an intermediary layer 2*r*, and a surface layer 2*s*, which are coated in layers in the listed order on the peripheral surface of the metallic core 2*q*. The undercoat layer 2*q* is formed of foamed sponge for reducing charging noises. The surface layer 2*s* is a protective layer provided to preventing the occurrence of leak even if the photosensitive drum 1 has defects such a pinholes. More concretely, the specifications of the cleaning roller 2 in this embodiment are as follows:

Metallic core 2*p*: a piece of round stainless rod which is 6 mm in diameter Undercoat layer 2*q*: foamed EPDM in which carbon particles were dispersed, and which is 0.5 g/cm$^3$ in specific gravity, $10^2$-$10^9$Ω in volume resistivity, and 3.0 mm in thickness Intermediary layer 2*r*: NBR rubber in which carbon particles were dispersed, and which is $10^2$-$10^5$Ω in volume resistivity, and 700 μm in thickness Surface layer 2*s*: fluorine resin in which stannic oxide particles and carbon particles were dispersed, and which is $10^7$-$10^{10}$Ω in volume resistivity, 1.5 μm in surface roughness (10 point surface roughness Ra in JIS, and 10 μm in thickness.

The charge roller 2 is kept pressed toward the rotational axis of the photosensitive drum 1 by a pair of compression springs 2*t*, in such a manner that a preset amount of contact pressure is maintained between the charge roller 2 and photosensitive drum 1, forming thereby a charging nip a, that is, the area of contact between the photosensitive drum 1 and charge roller 2. Further, the charge roller 2 is rotated by the rotation of the photosensitive drum 1 in the direction indicated by an arrow mark R2 in the drawing. In this embodiment, the overall volume resistivity of the charge roller 2 is $1.0\times10^5$Ω.

The charged photosensitive drum 1 is scanned by (exposed to) a beam of light projected by the exposing device 3 while being modulated according to the information of the image to be formed. In this embodiment, the exposing device 3 is a laser beam scanner which employs a semiconductor laser. The exposing device 3 outputs a beam of laser light while modulating the beam with the image formation signals inputted from a host processing device such as an image reading device. The beam of laser light scans the charged peripheral surface of the photosensitive drum 1. Consequently, an electrostatic latent image (electrostatic image) which reflects the inputted image formation signals, is effected upon the peripheral surface of the photosensitive drum 1. In this embodiment, as a given charged point of the peripheral surface of the photosensitive drum 1 is illuminated with the beam of laser light, its potential level V1 becomes −200 V.

The electrostatic latent image formed on the peripheral surface of the photosensitive drum 1 is developed (into visible image) by the developing device 4 which uses toner as developer. The developing devices 4Y, 4M, 4C and 4K contain yellow, magenta, cyan and black toners, respectively. Each developing device 4 has a driver roller, as a developer bearing member, which conveys toner to an area of development where the developing device 4 opposes the photosensitive drum 1. To the development roller, a development bias (development voltage) which is a combination of a DC voltage (Vdc) and an AC voltage (Vac) is applied. More concretely, in this embodiment, the development bias is an alternating voltage which is a combination of −500 V of DC voltage and AC voltage which is 1800 V in peak-to-peak voltage and 8 kHz in frequency. In this embodiment, a combination of the exposing device 3 and developing device 4 makes up a toner image forming means which forms a toner image on the charged peripheral surface of the photosensitive drum 1.

The toner image formed on the photosensitive drum 1 is transferred (primary transfer) by the function of the primary transfer roller 5, in the primary transferring section T1, onto the intermediary transfer belt 7 which is rotationally driven in the direction indicated by an arrow mark R3 in the drawing. During this process, a primary transfer bias (primary transfer voltage) which is DC voltage and is opposite in polarity from the polarity (normal polarity) of the toner is applied to the primary transfer roller 5 from a primary transfer voltage power source 51. In this embodiment, the primary transfer bias is set so that the amount of the primary transfer current which flows to the primary transfer roller 5 (primary transferring section T1) during the primary transfer becomes roughly 20 μA.

Here, in this embodiment, the primary transfer bias is controlled so that it remains stable at a preset level during the primary transfer process. More concretely, in this embodiment, the primary transfer bias is controlled so that the amount by which electrical current flows to the primary transfer roller 5 (primary transferring section T1) during the pre-rotation period, which will be described later, becomes a stable target value. Further, it is based on this target current value that the target value for the primary transfer bias for the primary transfer is obtained. Thus, during the primary transfer, the primary transfer bias is controlled so that it becomes stable at its target value. The target value for the primary transfer bias may be the value of the voltage applied to make the transfer current stable at a preset level, or a value obtained with the use of a mathematical expression, based on the value for making the transfer current stable, a lockup table, or the like. This type of control is well-known as ATVC in the field of printing device, and therefore, is not described in detail here.

For example, during an image forming operation for forming full-color images, four monochromatic toner images, different in color, are formed on the photosensitive drums 1 in the four stations SY, SM, SC and SK, one for one, and are sequentially transferred in layers onto the intermediary transfer belt 7 in the primary transferring sections T1. Consequently, the four monochromatic toner images, different in color, which are for forming a full-color image, are layered on the intermediary transfer belt 7.

The toner images formed on the intermediary transfer belt 7 are transferred (secondary transfer) onto a sheet of recording medium such as recording paper, by the function of the secondary transfer roller 8, in the secondary transferring section T2. During this process, the secondary transfer bias (secondary transfer voltage) which is DC voltage and is opposite in polarity from the toner charge (normal polarity of charged toner) is applied to the secondary transfer roller 8 from a secondary transfer voltage power source 81. Each sheet P of recording medium is conveyed to the secondary transferring section T2 by a pair of conveyance rollers 11, etc., of a recording medium feeding device with such a timing that it arrives at the secondary transferring section T2 at the same time as the toner images on the intermediary transfer belt 7.

After the transfer of the toner images onto the sheet P of recording medium, the sheet P is separated from the intermediary transfer belt 7, and is conveyed to a fixing device 9 as a fixing means. The fixing device 9 has a fixation roller 9*a* and a pressure roller 9*b* which form a fixation nip between themselves. It applies heat and pressure to the sheet P and the toner images thereon, by conveying the sheet P through the fixation nip while keeping the sheet P and the images thereon pinched by the fixation roller 9*a* and pressure roller 9*b*. Thus, the toner images are melted and mixed. Then, as they cool down, they become fixed to the sheet P. After the fixation of the toner images to the sheet P, the sheet P is discharged from the main assembly of the image forming apparatus 100.

The toner (primary transfer residual toner) remaining on the peripheral surface of the photosensitive drum 1 after the primary transfer is removed from the peripheral surface of the photosensitive drum 1 by the drum cleaning device 6, and is recovered. Moreover, the toner (secondary transfer residual toner) remaining on the outward surface of the intermediary transfer belt 7 after the secondary transfer is removed from the outward surface of the intermediary transfer belt 7 by the belt cleaning device 30, and is recovered.

By the way, in this embodiment, the image forming apparatus 100 is not provided with a discharging means, such as a pre-exposing device, which is to be disposed on the downstream side of the primary transferring section T1 and on the upstream side of the charging section in which the peripheral surface of the photosensitive drum 1 is charged by the charge roller 2, in terms of the rotational direction of the photosensitive drum 1.

2. Operational Sequence

Figure 3:
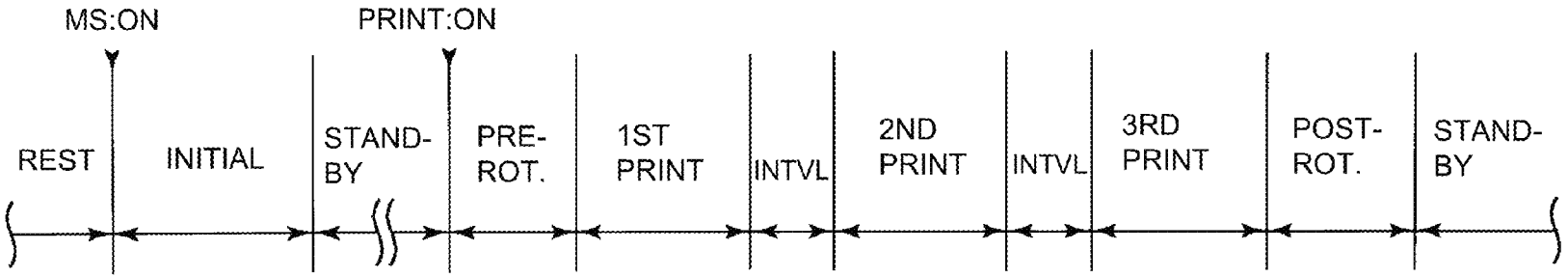
FIG. 3 is a drawing which shows the operational sequence of the image forming apparatus in the first embodiment.

FIG. 3 is a drawing of the operational sequence of the image forming apparatus 100.

a. Initialization Rotation Period (Preparatory Multiple Rotation Period)

The initialization period is an operational period which occurs immediately after the image forming apparatus 100 is started up (startup period, startup operation period, warm-up period). In the initialization period, as the electric power source of the image forming apparatus 100 is turned on, the photosensitive drum 1 begins to be rotationally driven, and operations for preparing preset processing devices for image formation, such as starting up the fixing device 9 (increasing temperature of fixing means of fixing device 9 to preset level), are carried out.

b. Preparatory Rotation Period for Printing (Pre-Rotation Period)

The preparatory period for printing is a period between when a print signal (signal for starting image formation) is inputted into the image forming apparatus 100 and when the operation for actually forming images is started. In a case where a print signal is inputted during the initialization rotation period, the preparatory process for printing is carried out as soon as the initial rotation process is completed. In a case where no print signal is inputted during the initialization rotation period, the driving of the main motor is temporarily stopped after the completion of the initialization rotation process, the rotational driving of the photosensitive drum 1 is stopped, and the image forming apparatus 100 is kept on standby until a print signal is inputted. Then, as a print signal is inputted, the preparatory rotation process for printing is carried out.

c. Printing Process (Image Formation Process)

The printing process corresponds to the very period in which a toner image is formed on the photosensitive drum 1, the toner image is transferred onto a sheet P of recording medium, the toner image is fixed to the sheet P. To describe in detail, the charging, exposing, developing, primary transferring, secondary transferring, and fixing processes in the printing process are different in the timing with which they are carried out. In the continuous printing mode, the above-described printing process is repeatedly carried out by a number of times which corresponds to a preset print count (n=3 in FIG. 3).

d. Sheet Interval

The sheet interval is one of the periods which occur when the image forming apparatus 100 is in the continuous printing mode. It is a period between when the trailing edge of a sheet P of recording medium passes the transferring section and when the leading edge of the following sheet P of recording medium arrives at the transferring section. That is, it is a period in which no sheet P is in the transferring section.

e. Post-Rotation Period (Process)

The post-rotation process corresponds to the period which follows the outputting of the last print (last sheet P of recording medium) in the printing process. It corresponds to the period in which the photosensitive drum is rotationally driven for a while for the post-rotation operation after the completion of the printing process.

f. Standby Period

As the preset post-rotation is ended, the driving of the main motor is stopped, and the rotational driving of the photosensitive drum 1 is stopped. Then, the image forming apparatus 100 is kept on standby until the next print signal is inputted. In a case where only a single print needs to be made, the image forming apparatus 100 is put through the post-rotation process after the outputting of the single print. Then, it is put on standby. If a print signal is inputted while the image forming apparatus 100 is kept on standby, the image forming apparatus 100 begins to be rotated to be prepared for the very process for printing.

The above-described printing process c corresponds to the image formation period, whereas the above described initial rotation process a, printing pre-rotation process b, sheet interval d, and post-rotation process e correspond to the periods in which no image is formed. By the way, an operational sequence which is initiated by a printing signal to form an image on a single sheet P of recording medium, or images on two or more sheets P of recording medium, and which comprises the above descried printing preparation rotation process, printing process, sheet interval, post-rotation process, etc., may be referred to as an image outputting operation (job).

3. Control Sequence

Figure 4:
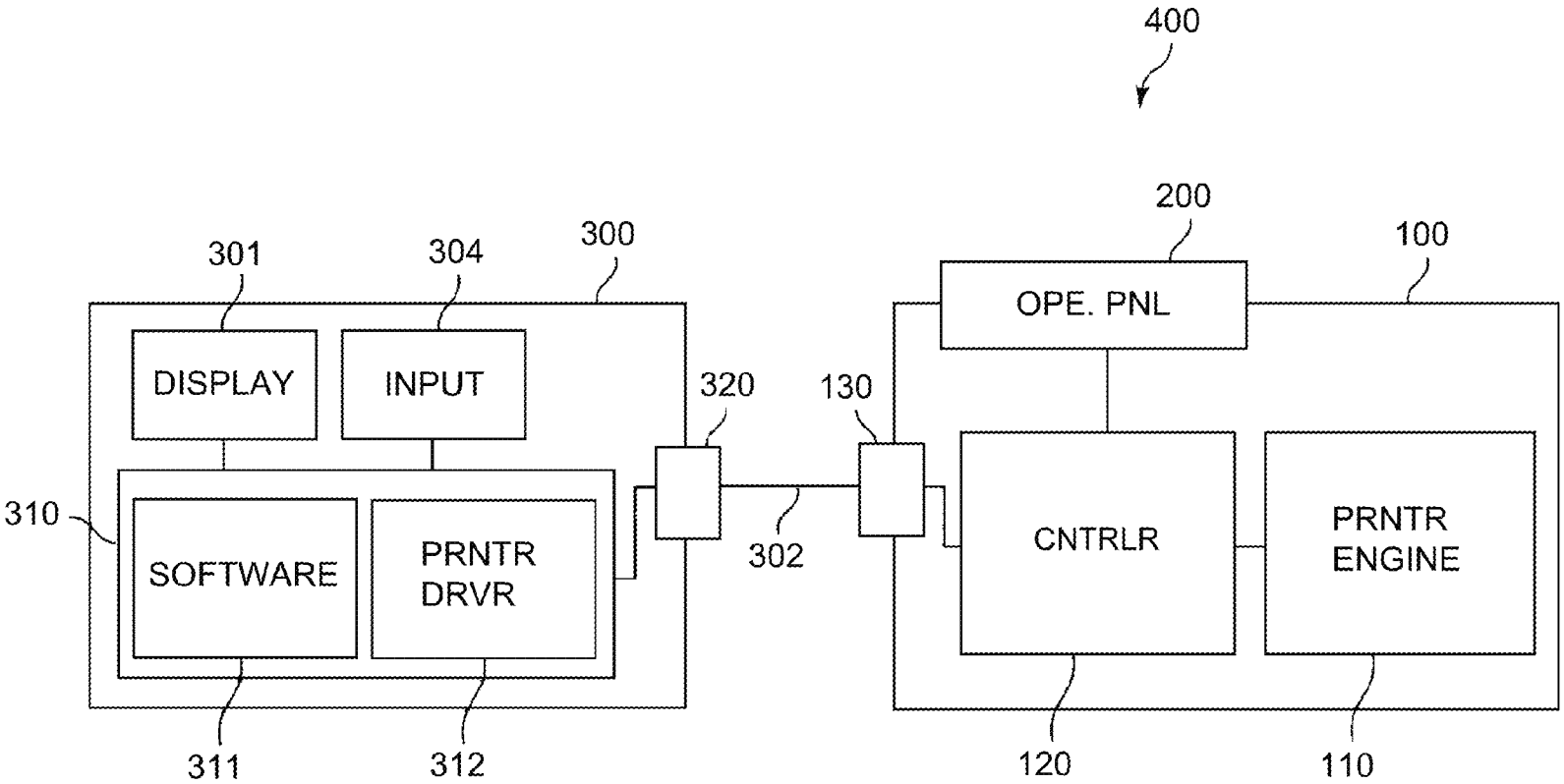
FIG. 4 is a block diagram of the image formation system in the first embodiment, and shows the configuration of the system.

FIG. 4 is a block diagram of an image formation system which comprises the image forming apparatus 100, and a personal computer 300 (which hereafter may be referred to simply as "PC"), and which is controlled by a printer driver.

The image forming apparatus 100 has a printer engine 110 in its main assembly. The printer engine 110 is one of the primary structural components for forming an image on a sheet P of recording medium, and outputting the formed image. It comprises each of the above described image forming sections S, intermediary transfer belt 7, fixing device 9, etc. Further, the image forming apparatus 100 has a controlling section 120 in its main assembly. The controlling section 120 controls the entirety of the image forming operation of the image forming apparatus 100. Further, image forming apparatus 100 has a control panel 200, through which an instruction to start an image outputting operation, and settings for the image outputting operation, are inputted, and on which information is displayed. Further, the image forming apparatus 100 is provided with an unshown image reading device (image scanner).

The image forming apparatus 100 is in connection to a PC 300 as an information processing peripheral device. In this embodiment, the PC 300 is connected to the image forming apparatus 100 through a LAN cable 302, interface of the image forming apparatus 100, and interface 320 of the PC 300, in such a manner that communication is possible between the PC 300 and image forming apparatus 100. By the way, it is not mandatory that the image forming apparatus 100 and PC 300 are connected to each other by wire. That is, the image forming apparatus 100 and PC 300 may be in connection to each other by wireless communicating means.

The PC 300 has a main assembly 310 as the primary structural component. The main assembly 310 may be an ordinary computer which comprises a computing device and storage sections. It is operated (controlled) by a basic operating system (OS). Further, the PC 300 has a display 301 as an information displaying section, such as an LCD display, an inputting section 304 such as a keyboard, a mouse, etc. Further, the PC 300 contains optional application software 311 (application program) such as a word processor, which operates on the basic OS. Further, the PC 300 contains a printer driver 312 (driver program) which operates on the basic OS. The printer driver 312 controls the image forming apparatus 100 by transmitting commands (information regarding image to be formed, information regarding settings for image forming operation) related to an image outputting operation, to the controlling section 120.

With the presence of the above described system, not only is the image forming apparatus 100 enabled to function as a copying machine to read an original and create a copy of the read original, but also, function as a printer to form an image which reflects the information inputted from the PC 300 regarding an image to be formed.

In this embodiment, the controlling section 120 functions as a toner amount adjusting means which reduces the amount by which toner is adhered to the peripheral surface of the photosensitive drum 1 per unit area, to effect the secondary color, in the upstream image forming section(s), to a value which is less than the standard value. Further, the controlling section 120 functions as an electric current adjusting means which increases the amount by which the primary transfer current is supplied to the primary transfer roller(s) in the downstream image forming section(s), to a value which is more than the standard value.

4. Transfer Ghost

Figure 10:
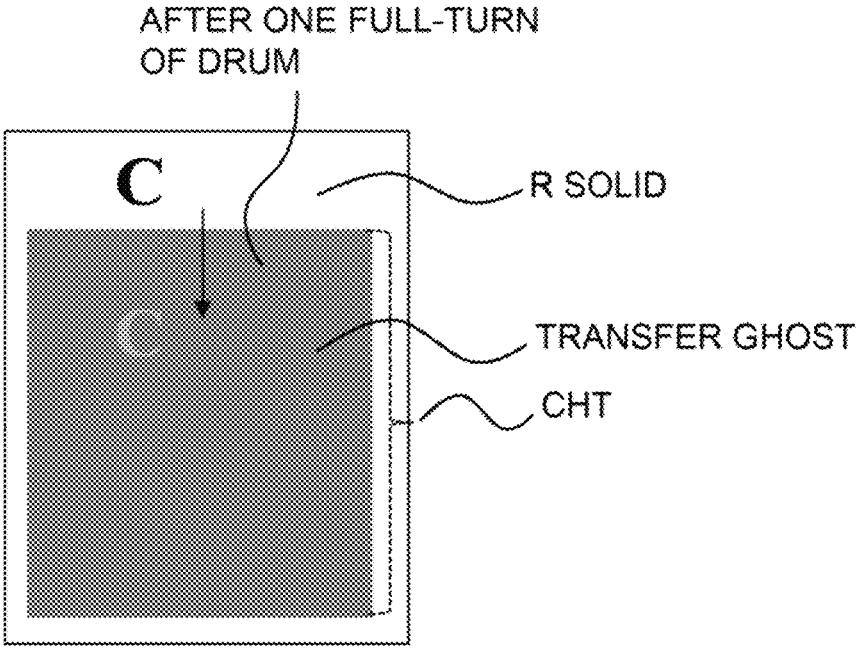
FIG. 10 is a schematic drawing of an example of an image having a transfer ghost.

FIG. 10 is a schematic drawing of an image having transfer ghosts. It shows a phenomenon that in a case where an image is formed on a sheet of recording paper by forming first a solid red R image by layering yellow (Y) and magenta (M) solid toner images on the sheet P of recording paper, and then, layering a solid cyan (C) halftone image on the same sheet P of recording paper, the portion of the solid cyan (C) halftone area of the resultant image, which corresponds to the portion of the peripheral surface of the photosensitive drum 1, which corresponded to the formation of the solid red R image, appears less in density.

Figure 11:
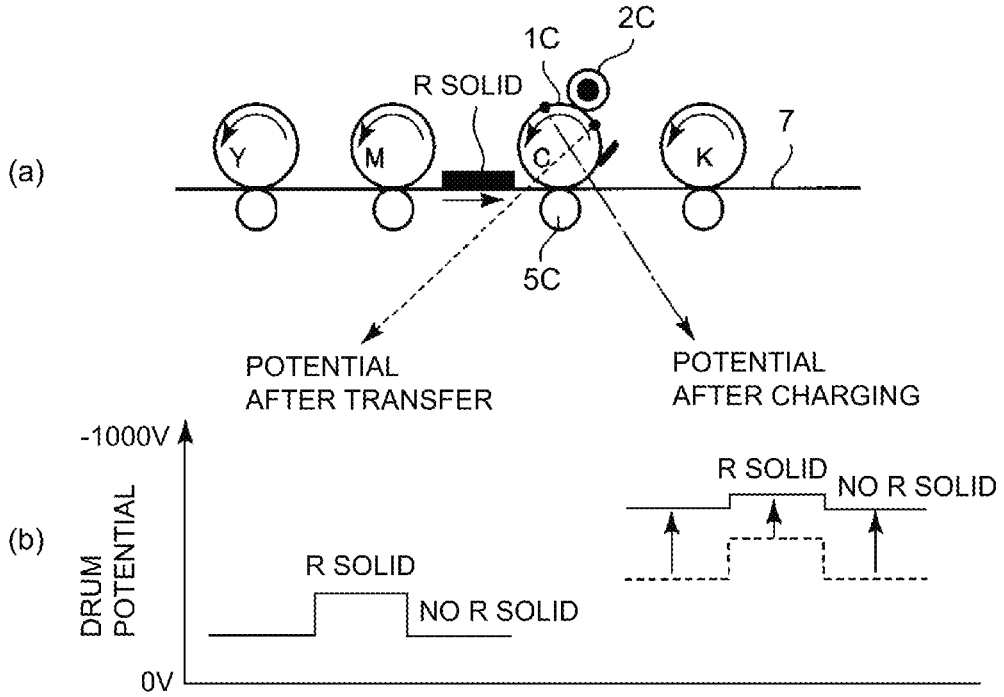
FIG. 11 is a schematic drawing for describing the mechanism of the occurrence of a transfer ghost.

This phenomenon is described further with reference to FIG. 11. Part (a) of FIG. 11 is a schematic drawing of the image forming sections SY, SM, SC and SK, and shows their structure. Part (b) of FIG. 11 shows the relationship between the surface potential level (which hereafter may be referred to as "post-transfer potential level") of a given point of the peripheral surface of the photosensitive drum 1C in the station C, after the passage of the given point through the primary transfer section T1C, and that after charging by charge roller 2C (which hereafter may be referred to as "post-charging potential level"). The vertical axis of part (b) of FIG. 11 is graduated so that the greater (in absolute value of negative potential level) the peripheral surface of the photosensitive drum 1 is, the higher the peripheral surface of the photosensitive drum 1 is in potential level.

Referring to part (a) of FIG. 11, as the solid red R image formed by the station SY and SM is conveyed by the intermediary transfer belt 7 through the primary transfer section T1C of the station SC, the portion of the peripheral surface of the photosensitive drum 1C, which corresponds to the portion of the intermediary transfer belt 7, which has the solid red R image, becomes higher in potential level (negatively) compared to the portion of the peripheral surface of the photosensitive drum 1C, which does not correspond in position to the solid red R image on the intermediary transfer belt 7, as shown in part (b) of FIG. 11, for the following reason. That is, the toners, of which the solid red R image is formed, function as an electrical resistor, reducing thereby the amount by which the primary transfer current is flowed by the primary transfer voltage through this portion of the peripheral surface of the photosensitive drum 1. Thus, this portion of the peripheral surface of the photosensitive drum 1 does not fully reduce in potential. After this portion of the peripheral surface of the photosensitive drum 1C comes out of the primary transferring section T1C, it is charged by the charge roller 2C. However, the hysteresis of the difference in potential level between the portion of the peripheral surface of the photosensitive drum 1C, which corresponds in position to the red R image on the intermediary transfer belt 7, and the other portion of the peripheral surface of the photosensitive drum 1C, slightly remains even after the peripheral surface of the photosensitive drum 1C is charged by the charge roller 2C. This difference in potential level between the two portions makes the corresponding two portions of the resultant image different in density (tone), creating an effect of the presence of the ghost of the red R image. This is the "transfer ghost".

As described above, a "transfer ghost" is such a phenomenon that is attributable to the phenomenon that in the case of an image forming apparatus of the so-called tandem type, the toner transferred onto the intermediary transfer belt 7 in the upstream stations S in terms of the moving direction of the intermediary transfer belt 7 makes the peripheral surface of the downstream photosensitive drum 1 nonuniform in the post-transfer potential level (that is, the pre-charging potential level). Thus, the greater the amount by which toner is borne by the intermediary transfer belt 7 in the upstream stations S, the more conspicuous the resultant transfer ghost. Therefore, an image of the red R color, which is the secondary color, formed of yellow (Y) and magenta (M) toners, for example, has an effect upon the portions of the final image, which have cyan (C) and/or black (K) color. Similarly, a green (G) image, that is, an image of the secondary color, which is formed of yellow (Y) and cyan (C) toners, or a blue (B) image, that is, an image of the secondary color, which is formed of magenta (M) and cyan (C), are likely to have an effect upon a black (K) image.

Table 1 shows the relationship among the maximum amount (%) of toner on the area of an image, which has the secondary color, transfer ghost, and chroma of the secondary color. Here, an example of the maximum amount of toner of the secondary color R area is the sum of the amount by which yellow (Y) toner was borne by the intermediary transfer belt 7 in the station SY, or the first station, and the amount by which magenta (M) toner was borne by the intermediary transfer belt 7 in the station SM, or the second station. In this embodiment, the maximum amount of toner for red R color, or the secondary color, was set to 1.0 (mg/cm$^2$), which corresponds to 200% in Table 1. Regarding image evaluation in terms of transfer ghost, test images such as those shown in FIG. 10 were outputted, and were visually (subjectively) evaluated. "○" in Table indicates that the transfer ghost did not occur, and "Δ" indicates that the transfer ghost occurred, but is not problematic in severity in practical terms. "X" indicates that the transfer ghost which was problematic in severity occurred. As for the evaluation of the images in terms of the chroma of the secondary color, test images such as those shown in FIG. 10 were outputted, and were visually (subjectively) evaluated. "○" in Table 1 indicates that the images had satisfactorily high chroma, and "Δ" indicates that the images were slightly inferior in chroma, but were not problematic in practical terms. "X" indicates that the images were so low in chroma that they were problematic in practical terms. The maximum amount of toner for the secondary color R can be adjusted by adjusting the amount by which the photosensitive drum 1 is exposed by the exposing device 3 to form monochromatic yellow (Y) and magenta (M) toner images.

Further, Table 2 shows the relationship among the amount of the primary transfer current, transfer ghost, and coarseness which is described later, in this embodiment. Here, the primary transfer current is the primary transfer current in the station SC, or the third station in terms of the moving direction of the intermediary transfer belt 7, and the first transfer current in the station SK, or the fourth station S. As for the evaluation in terms of coarseness, test images such as the one in FIG. 10 were outputted, and were visually (subjectively) evaluated. "○" in Table 2 indicates that the images did not appear coarse, and "Δ" indicates that the images appeared somewhat coarse, but were not appear coarse enough to be problematic in practical terms. "X" indicates that the images appeared coarse enough to be problematic.

In the case of the image forming apparatus 100 in this embodiment, the normal setting (default setting, referential setting), that is, the pre-adjustment setting, for the maximum amount of toner for red R color (secondary color) was 200%, and the amount (target current value) of the primary transfer current for the station SC for color (C), and that for the station SK for color (K) was 20 μA. The values in Table 2 were those obtained by making adjustments so that the amount of the primary transfer current in the station SC for color (C) and that in the station SK for color (K) became 20 μA. By the way, the results shown in Table 2 were those obtained by making adjustment so that the maximum amount by which toners were to be borne for color R or the secondary color. By the way, these normal settings are for an environment which is normal in temperature and humidity.

TABLE 1

| 2ry Color max. amount (%) | Transfer ghost | Chroma of 2ry color |
|---|---|---|
| 200 | X | ○ |
| 180 | X | ○ |
| 160 | X | Δ |
| 140 | ○ | X |

TABLE 2

| 1ry transfer current (μA) | Transfer ghost | Coarseness |
|---|---|---|
| 20 | X | ○ |
| 22 | X | ○ |
| 24 | X | Δ |
| 26 | Δ | X |
| 28 | ○ | X |

Referring to Table 1, as the maximum amount of toners for color red R, which is the secondary color, the amount of toners which function as electrical resistor in the primary transferring station T1 in the station SC, and that in the station SK, reduces. Thus, it becomes easier for the primary transfer current to flow when the primary transfer bias is applied. Consequently, it becomes less likely for a transfer ghost to appear, or a transfer ghost is likely to be less conspicuous even if it appears. However, as the maximum amount of toners for color R which is the secondary color is reduced, the area of the image, which has color R, reduces in chroma.

Further, referring to Table 2, as the stations SC and SK for the colors C and K, respectively, are increased in the amount of the primary transfer current, it becomes easier for the primary transfer voltage to flow even with the presence of the toners between the photosensitive drum 1 and intermediary transfer belt 7. Thus, it is less likely for a transfer ghost to appear, or a transfer ghost is likely to be less conspicuous even if it appears. However, as the stations SC and SK for colors C and K, respectively, are increased in the amount of the primary transfer current, images are likely to suffer from an image defect called "coarseness", the extent of which is proportional to the amount by which the primary transfer current is increased. "Coarseness" is an image defect attributable to a phenomenon that after toner is transferred from the photosensitive drum 1 onto the intermediary transfer belt 7, it is reversed in polarity (made positive) in the primary transferring section T1, and then, is returned (transferred back) to the photosensitive drum 1.

Decreasing the maximum amount of toners for color R which is the secondary color, and increasing the primary transfer current in the stations SC and SK (which hereafter will be referred to as "downstream stations S") for colors C and K, respectively, are both effective to prevent the occurrence of a transfer ghost, or reducing the level of conspicuousness at which a transfer ghost appears. However, employing only one of the above described tactics made it difficult to achieve both objectives, that is, prevention of the occurrence of a transfer ghost, or minimization of the level of conspicuousness at which the transfer ghost appears, and prevention of the occurrence of the above described image defects (reduction in chroma of secondary colors, and coarseness).

Table 3 shows the relationship among the maximum amount of toners for the secondary color, amount of the primary transfer current, transfer ghost, chroma of the secondary color, and coarseness, which occurred when the maximum amount of toners for the secondary color was reduced, and the amount of the primary transfer current in the downstream stations S was increased.

TABLE 3

| 2ry Color max. amount (%) | 1ry Transfer current (μA) | Transfer Ghost | 2ry Chroma | Coarseness |
|---|---|---|---|---|
| 200 | 20 | X | O | O |
| 200 | 22 | X | O | O |
| 200 | 24 | X | O | Δ |
| 200 | 26 | Δ | O | X |
| 200 | 28 | O | O | X |
| 180 | 20 | X | O | O |
| 180 | 22 | X | O | O |
| 180 | 24 | Δ | O | Δ |
| 180 | 26 | O | O | X |
| 180 | 28 | O | O | X |
| 160 | 20 | X | Δ | O |
| 160 | 22 | Δ | Δ | O |
| 160 | 24 | O | Δ | Δ |
| 160 | 26 | O | Δ | X |
| 160 | 28 | O | Δ | X |
| 140 | 20 | Δ | X | O |
| 140 | 22 | O | X | O |
| 140 | 24 | O | X | Δ |
| 140 | 26 | O | X | X |
| 140 | 28 | O | X | X |

As will be evident from Table 3, for the purpose of preventing a transfer ghost from appearing in an image such as the one shown in FIG. 10, for example, it is desired to reduce the maximum amount of toners for the secondary color from 200% to 160%, and increase the primary transfer current in the downstream stations S from 20 μA to 24 μA. With the employment of these tactics, it is possible to prevent the occurrence of a transfer ghost, or make as low as possible the level of conspicuousness at which a transfer ghost appears, without excessively reducing the secondary color R in chroma, and also, without raising the level of coarseness at which an image will appear.

By the way, Tables 1 and 3 are related to the maximum amount of toners for the secondary color R (combination of primary colors Y and M). However, the maximum amount of toners for the secondary colors G (combination of primary color Y and C) and B (combination of primary colors M and C) is also related to the occurrence of a transfer ghost in the stations SK for the color K as was described previously. In this embodiment, therefore, for the purpose of reducing the maximum amount of toners for the secondary color in a transfer ghost prevention mode which is described later, the maximum amount of toners for other secondary colors, that is, colors G and B, is also reduced like the above described maximum amount of toners for the secondary color R.

4. Transfer Ghost Suppression Mode

The image forming apparatus 100 is configured so that it can carry out an image outputting operation in a transfer ghost suppression mode, in which it is reduced in the maximum amount of toners for the secondary color, and is increased in the amount of the primary transfer current in the downstream stations S, based on the results of the above described research. In particular, this embodiment is described with reference to a case where when a user makes the image forming apparatus 100 carry out an image outputting operation (copying operation) by inputting a printing command through the control panel 200 with which the main assembly of the image forming apparatus 100 is provided, the user makes the image forming apparatus 100 carry out the image outputting operation in a transfer ghost suppression mode by inputting a mode setting command through the control panel 200. In the case of the image forming apparatus 100 in this embodiment, in a case where a user wants to output images which are likely to suffer from a transfer ghost, or the user found a transfer ghost in the outputted images, the user can make the image forming apparatus 100 carry out the image outputting operation in a transfer ghost suppression mode, if the user wishes.

In this embodiment, in the transfer ghost suppression mode, the maximum amount of toners for the secondary color is reduced from the normal setting, which is 200%, to 160%, and the primary transfer current (target current amount) for the downstream stations S is increased from the normal setting, which is 20 μA, to 24 μA.

Figure 5:
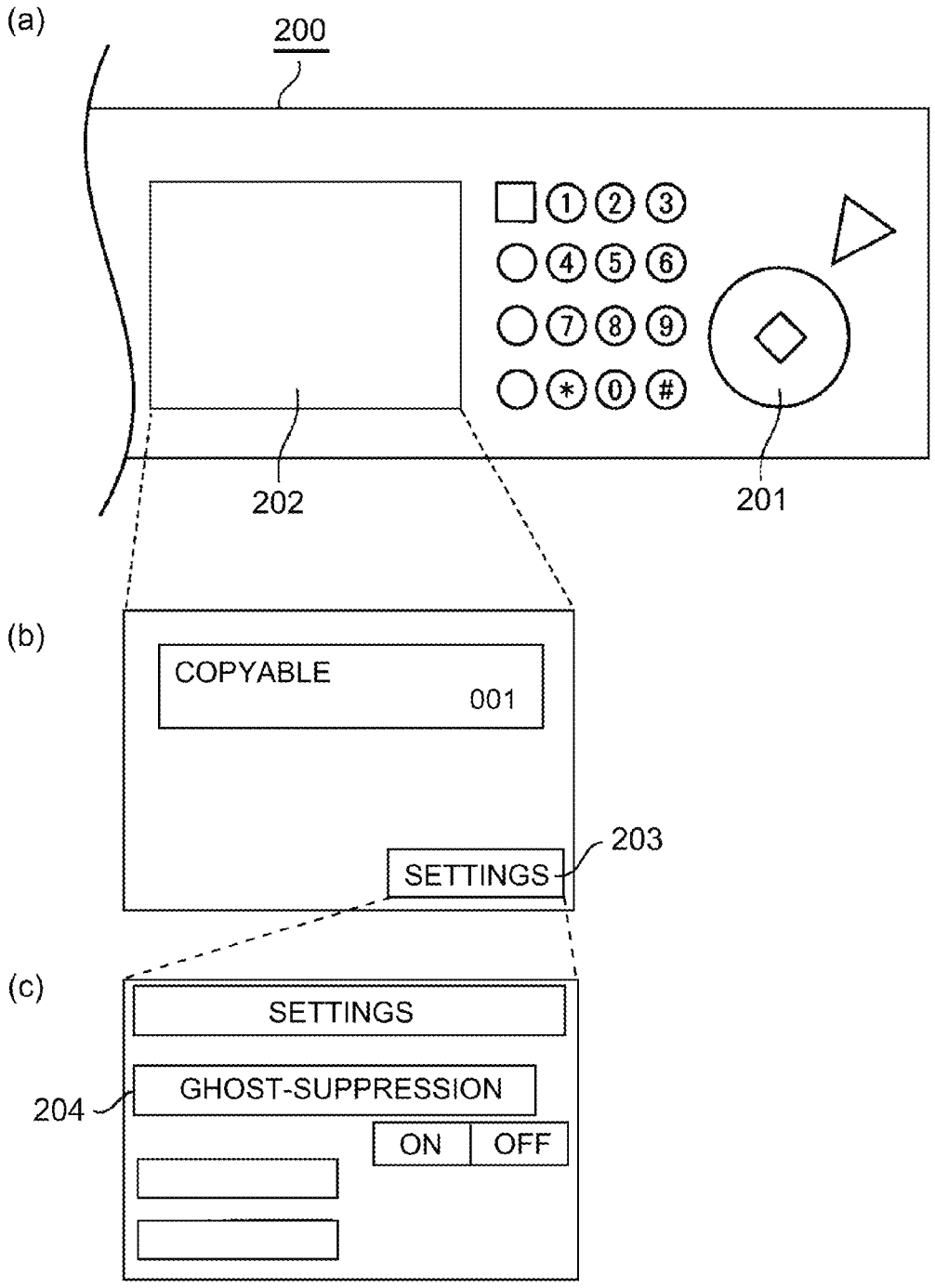
FIG. 5 is a schematic drawing of an example of the display portion of the control panel of the image forming apparatus in the first embodiment.

Next, referring to FIG. 5, the control panel 200 of the image forming apparatus 100 is described. Part (a) of FIG. 5 is a schematic external view of the control panel 200. The control panel 200 has a start button 201 for making the image forming apparatus 100 start an image outputting operation (copying operation) based on the inputted information. It has also a display 202 (touch panel) which functions as an information inputting section as well as an information displaying section. A user is allowed to input various settings for an image outputting operation through the control panel 200 by making selections by pressing (touching) the buttons displayed on the display 202.

Part (b) of FIG. 5 shows an example of the initial screen of the display 202. Referring to part (b) of FIG. 5, the initial screen has a button for displaying various buttons which a user can use to choose various settings for an image outputting operation. Part (c) of FIG. 5 shows an example of a screen which has the buttons for selecting various settings. Referring to part (c) of FIG. 5, this screen has a transfer ghost suppression mode button 204 (which hereafter may be referred to as "mode selection button") for placing the image forming apparatus 100 in a transfer ghost suppression mode, or moving the image forming apparatus 100 out of a transfer ghost suppression mode. As a user places the image forming apparatus 100 in a transfer ghost suppression mode with the use of the mode setting button 204, it becomes possible for the image forming apparatus 100 to carry out an image outputting operation in a transfer ghost suppression mode such as the above described one. The mode setting button 204 is an example of a means for activating both the toner amount adjusting means and current amount adjusting means during an image outputting operation. A user can make the image forming apparatus 100 carry out an image outputting operation in a transfer ghost suppression mode by placing the image forming apparatus 100 in a transfer ghost suppression mode with the use of the mode setting button 204, shown in part (c) of FIG. 5, and then, pressing (touching) the start button 201, shown in part (a) of FIG. 5.

Figure 6:
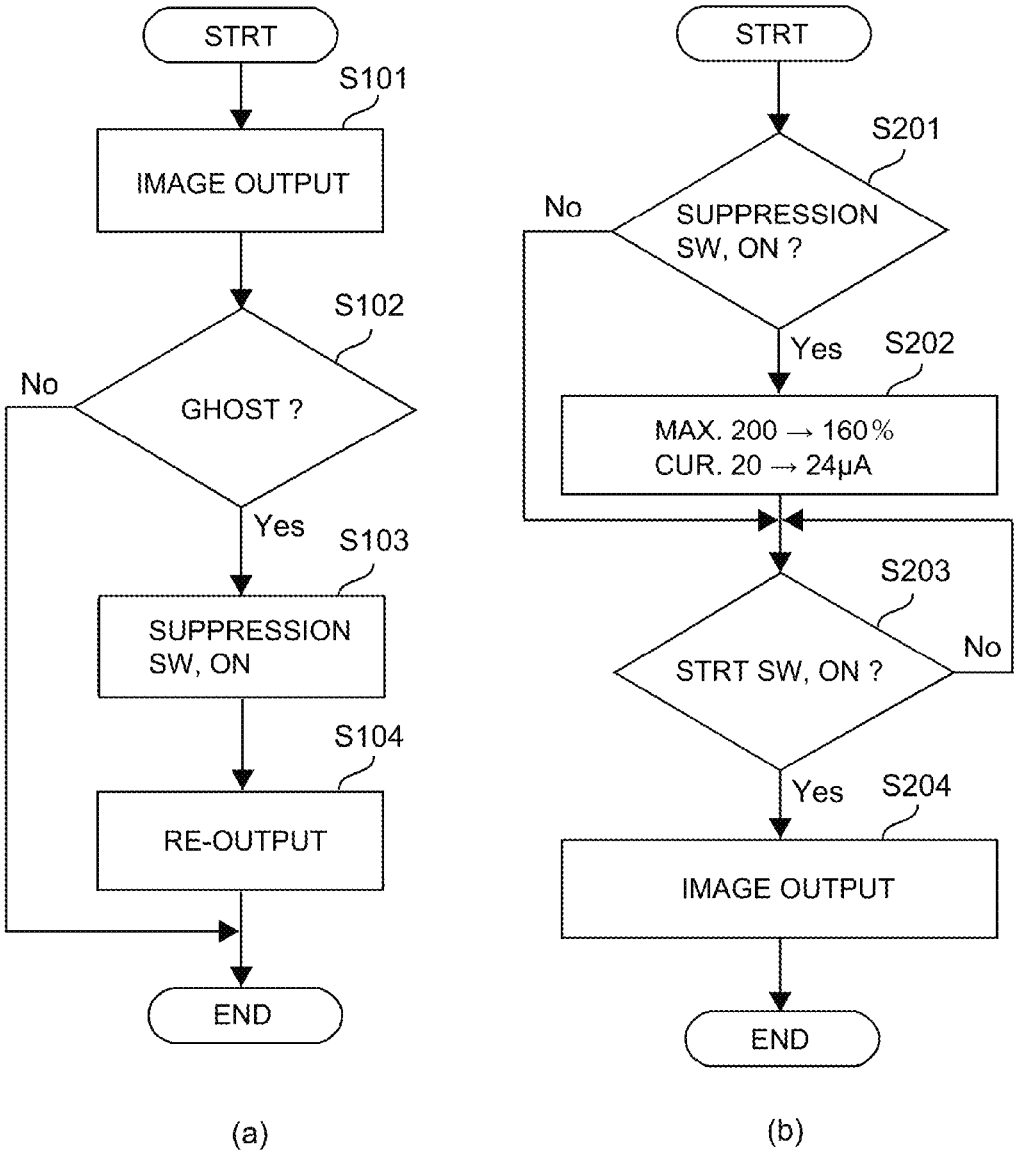
FIG. 6 is a flowchart for describing the operation of the image forming apparatus in the first embodiment.

FIG. 6 is a flowchart for describing the operation of the image forming apparatus 100 in this embodiment. Part (a) of FIG. 6 shows the operational sequence to be followed by a user, and part (b) of FIG. 6 shows the operational sequence which is followed by the control section 120 of the image forming apparatus 100. By the way, FIG. 6 primarily shows the steps which are related to the procedure for placing the image forming apparatus 100 in a transfer ghost suppression mode. That is, FIG. 6 does not show many of other steps (optional steps).

Referring to part (a) of FIG. 6, a user is to output an image with the use of the image forming apparatus 100 (S101). If the user determines that a transfer ghost has occurred (S102), the user is to choose a transfer ghost suppression mode with the use of the control panel 200 (S103), and make the image forming apparatus 100 output the same image for the second time (S104). More specifically, the user is to press (touch) the mode selection screen button on the display 202 of the control panel 200, and press (touch) the mode setting button 204 on the display 202 of the control panel 200. On the other hand, if the user determines that a transfer ghost did not occur to the first image outputted by the image forming apparatus 100, the user is not required to do anything. By the way, if the user determines in advance that the image to be outputted is such an image that is likely to cause a transfer ghost, the user is allowed to put the image forming apparatus 100 in a transfer ghost suppression mode prior to the outputting of the first image, in order to make the image forming apparatus 100 carry out an image outputting operation in a transfer ghost suppression mode from the very beginning.

Referring to part (b) of FIG. 6, as the mode setting button 204 of the control panel 200 is touched (S201), the controlling section 120 of the image forming apparatus 100 changes the maximum amount of toners for the secondary color and primary transfer current amount to the values for a transfer ghost suppression mode (S202). That is, it reduces the toner amount for the secondary color from the maximum amount of toners for the secondary color, which is 200%, to 160%, and increases the setting of the primary transfer current amount for the downstream stations S from 20 μA to 24 μA. Then, as the start button 201 is touched (S203), the controlling section 120 makes the image forming apparatus 100 carry out an image outputting operation (S204).

As described above, in this embodiment, the image forming apparatus 100 employs the DC charging method, and is not provided with a discharging device such as a pre-exposing device. That is, it is structured to be inexpensive, and advantageous in terms of size reduction. According to this embodiment, even if an image forming apparatus is structured like the image forming apparatus 100 in this embodiment, it is possible to suppress the occurrence of such a transfer ghost which is likely to be generated by a solid area of an image, which has the secondary color and is formed in the upstream stations S, across the halftone areas of the same image, in the downstream stations S. Further, both the setting for reducing the maximum amount of toners for the secondary color, and setting for increasing the primary transfer current, can be done at the same time. That is, it is unnecessary for a user to separately choose the two settings. In other words, the occurrence of a transfer ghost can be suppressed by a simple operation. Further, according to this embodiment, it is possible to suppress the occurrence of a transfer ghost while preventing the problem that the attempt to suppress the occurrence of a transfer ghost will likely to result in the formation of images which have less chroma, and/or coarse across its secondary color portions.

Embodiment 2

Next, another embodiment of the present invention is described. In terms of basic structure and operation, the image forming apparatus 100 in this embodiment is the same as that in the first embodiment. Therefore, its elements which are the same in function and/or structure as the counterparts in the first embodiment are given the same referential codes as those given to the counterparts, one for one, and are not described here.

The first embodiment was described with reference to a case where a transfer ghost suppression mode was selected with the use of the control panel 200 with which the image forming apparatus 100 was provided. In comparison, this embodiment is described with reference to a case where the image forming apparatus 100 is made to carry out an image outputting operation in a transfer ghost suppression mode when the image forming apparatus 100 carries out an image outputting operation (printing operation) in response to a command from the PC 300. The PC 300 is in connection with the image forming apparatus 100 so that communication is possible between two apparatuses. The PC 300 is an example of an apparatus (information processing peripheral device, etc.) which is combined with the image forming apparatus 100 to make up an image formation system 400. The printer driver 312 of the PC 300 makes up a controlling device which transmits to the image forming apparatus 100, the information about the image to be formed, and the information about the settings for an image outputting operation.

In this embodiment, in a transfer ghost suppression mode, the setting for the maximum amount of toners for the secondary color is reduced from the normal setting, which is 200%, to 160%, and the setting for the primary transfer current amount is increased from the normal setting which is 20 μA, to 24 μA, as they were in the first embodiment.

Figure 7:
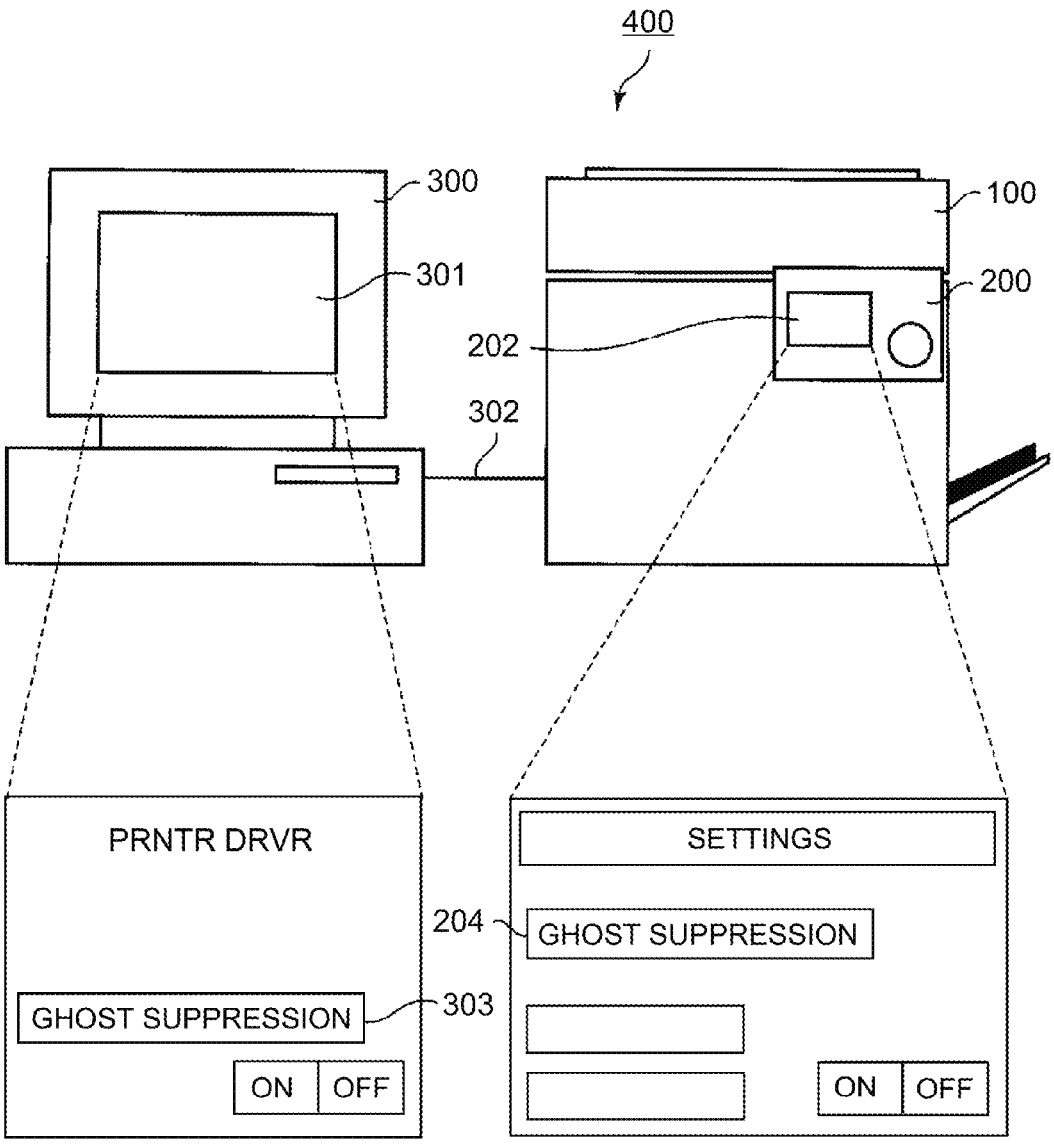
FIG. 7 is a schematic drawing of an example of a combination of the touch screen (touch panel) of the printer driver of the information processing peripheral device, and the control screen (touch panel) of the image forming apparatus, in the first embodiment.

FIG. 7 is a schematic drawing of the image formation system 400 in this embodiment. In this embodiment, the PC 300 is in connection with the image forming apparatus 100 through a LAN cable. The PC 300 is enabled to display images across its display 301 with the use of an application software 311 (FIG. 4), etc., which has been installed in the PC 300. Further, the PC 300 is enabled to command the image forming apparatus 100 to carry out an image outputting operation (printing operation) with the use of the printer driver 312 (FIG. 4) which has been installed in advance. That is, the PC 300 is enabled to transmit to the controlling section 120 (FIG. 4) of the image forming apparatus 100, the information about the image displayed across the above described display 301, for example, and the information about the settings for an image outputting operation, through the LAN cable 302. Further, in this embodiment, the printer driver 312 is enabled to transmit to the image forming apparatus 100, such information as print count, recording medium size, and also, the information about the setting for a transfer ghost suppression mode, as the settings for the image outputting operation.

FIG. 7 is an example of a touch panel screen displayed on the display 301 of the PC 300. Referring to FIG. 7, in this embodiment, the control panel screen of the printer driver 312 is provided with a button 303 (mode setting button) for setting a transfer ghost suppression mode. The mode setting button 304 is an example of the mode setting sections section which the PC 300 has and is provided by the printer driver 312. This mode setting button 304 is for activating both the toner amount adjusting means and current amount adjusting means when images are outputted by the image forming apparatus 100, as that in the first embodiment was. By the way, the printer driver 312 is enabled to make the display 301 of the PC 300 provide a user with multiple control screens which are different in function from the screen having the mode setting button 304, in addition to the above described screen having the mode selection button 303, although these screens are not shown in FIG. 7. These screens include a screen having buttons for selection sheet size, etc., a screen having a button for instructing the image forming apparatus 100 to start an image outputting operation, etc.

Figure 8:
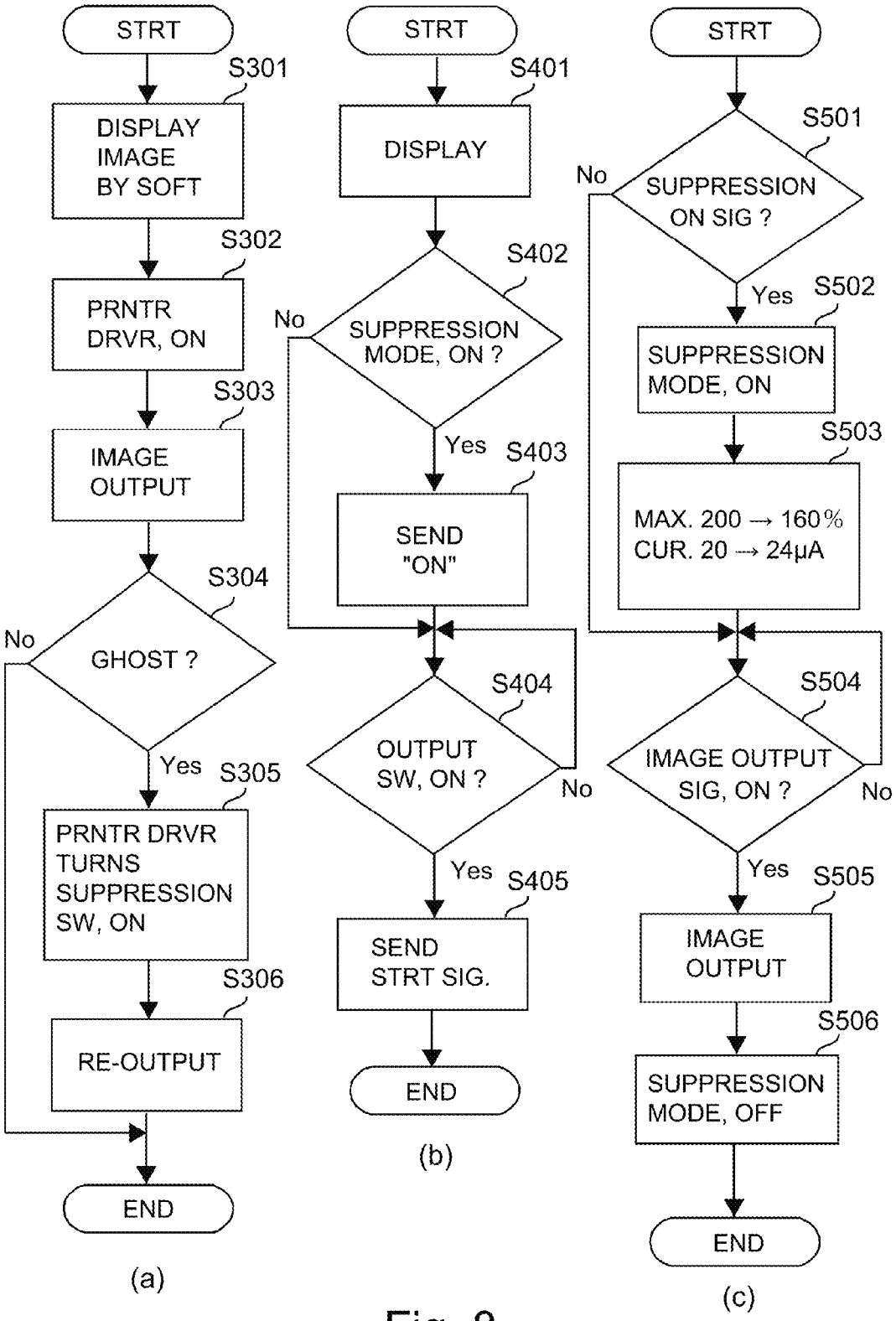
FIG. 8 is a flowchart for describing the operational sequence of the image forming apparatus in the second embodiment of the present invention.

FIG. 8 is a flowchart of the operational sequence of the image forming apparatus 100 in this embodiment. Part (a) of FIG. 8 is a flowchart of the operational sequence to be followed by a user, and part (b) of FIG. 8 shows the operational sequence for the printer driver 312. Part (c) of FIG. 8 shows the operational sequence to be followed by the controlling section 120 of the image forming apparatus 100. FIG. 8 primarily shows the portions of the operational sequence, which is related to a transfer ghost suppression mode section, and does not show various optional steps in the operational sequences.

Referring to part (a) of FIG. 8, a user is to display on the display 301 the PC 300, an image which the user want to output, with the use of the application software 311 or the like (S301). Then, the user is to start up the printer driver 312 of the application software 311 (S302). Then, the user is to make the image forming apparatus 100 output the image with the use of the printer driver 312 (S303). Next, if the user determines that the image outputted by the image forming apparatus 100 has a transfer ghost (S304), the user is to select a transfer ghost suppression mode with the use of the printer driver 312 (S303), and make the image forming apparatus 100 output the same image for the second time (S306).

Next, referring to part (b) of FIG. 8, as the printer driver 312 is started up from the application software 311, it displays a control panel screen on the display 301 of the PC 300 (S401). Then, as the mode setting button 304 on the control panel screen is touched (S402), the printer driver 312 transmits a command for placing the image forming apparatus 100 in a transfer ghost suppression mode, to the controlling section 120 of the image forming apparatus 100, through the LAN cable (S403). Further, as the button on the control panel screen, which is for making the image forming apparatus 100 carry out the image outputting operation, is touched (S404), the printer driver 312 transmits a command for making the image forming apparatus 100 start the image outputting operation, to the controlling section 120 of the image forming apparatus 100 through the LAN cable (S405).

Next, referring to part (c) of FIG. 8, as the controlling section 120 of the image forming apparatus 100 receives the signal for turning on a transfer ghost suppression mode, from the PC 300, (S501), it places the image forming apparatus 100 in a transfer ghost suppression mode only for the current job (S502). Then, the controlling section 120 reduces the setting for the maximum amount of toners for the secondary color from 200% to 160%, and increases the setting for the primary transfer current amount for the downstream stations S from 20 μA to 24 μA (S503). Thereafter, as the image outputting operation start signal is inputted from the PC 300 (S504), the controlling section 120 makes the image forming apparatus 100 carry out the image outputting operation (S505). After the completion of the job, the controlling section 120 takes the image forming apparatus 100 out of the transfer ghost suppression mode (S506).

As described above, according to this embodiment, not only can this image formation system provide the same effects as those obtainable by the image forming apparatus 100 in the first embodiment, but also, it can provide the following effect. That is, in this embodiment, it is possible to turn on a transfer ghost suppression mode, for each job, with the use of the printer driver 312 of the PC 300. Therefore, it does not occur that the image forming apparatus 100 remains in a transfer ghost suppression mode after the completion of each job. Thus, it does not occur that the setting for the transfer ghost suppression mode in the preceding image outputting operation affects the following image outputting operation which is for outputting images, the pattern of which is unlikely to trigger the occurrence of a transfer ghost. That is, in this embodiment, it is unnecessary for a transfer ghost suppression mode to be turned off by a user. In other words, this embodiment can eliminate the time necessary for a user to turn off a transfer ghost suppression mode, and also, deal with the problem that a user sometimes forgets to turn off a transfer ghost suppression mode. That is, this embodiment makes it possible to make the image forming apparatus 100 operate in a transfer ghost suppression mode only for a job which is for outputting images, the pattern of which is likely to trigger the occurrence of a transfer ghost, through a simple operation.

Embodiment 3

Next, another embodiment of the present invention is described. The basic structure and operation of the image forming apparatus in this embodiment are the same as those of the image forming apparatus 100 in the first embodiment. Therefore, the elements of the image forming apparatus in this embodiment, which are the same in function and/or structure as the counterparts in the first embodiment, are given the same referential codes as those given to the counterparts, one for one, and are not described here.

This embodiment is described with reference to a case where when the image forming apparatus 100 is made to carry out an image outputting operation (printing operation) by the PC 300, it is made to carry out the image outputting operation in a transfer ghost suppression mode as in the second embodiment. This embodiment, however, is different from the second embodiment in that in this embodiment, the setting for the maximum amount of toners for the secondary color for the image forming apparatus 100, and the setting for the primary transfer current amount for the downstream stations S, have been changed from the normal setting (normal settings).

There are cases where the setting for the maximum amount of toners for the secondary color for the image forming apparatus 100, and/or the setting for the primary transfer current amount for the image forming apparatus 100, have been changed in order to suppress the occurrence of other image defects than a transfer ghost. That is, it is possible that the image forming apparatus 100 will have been changed in the setting for the maximum amount of toners for the secondary color and/or primary transfer current amount, by an operator such as a user and a service person. For example, it is possible that in order to prevent the occurrence of the phenomenon that toner scatters from fine lines of an image, the image forming apparatus 100 will be reduced in the maximum amount of toners for the secondary color. Further, it is possible that in order to prevent the occurrence of the problem that the image forming apparatus 100 outputs coarse images, the coarseness of which is attributable to the retransfer of toner, which occurs in the primary transferring section, the image forming apparatus 100 will be reduced in the primary transfer current amount.

In this embodiment, therefore, in a case where the image forming apparatus 100 is placed in a transfer ghost suppression mode by the printer driver 312, this transfer ghost suppression mode set by the printer driver 312 is prioritized over any operation mode set by or through the image forming apparatus 100.

Figure 9:
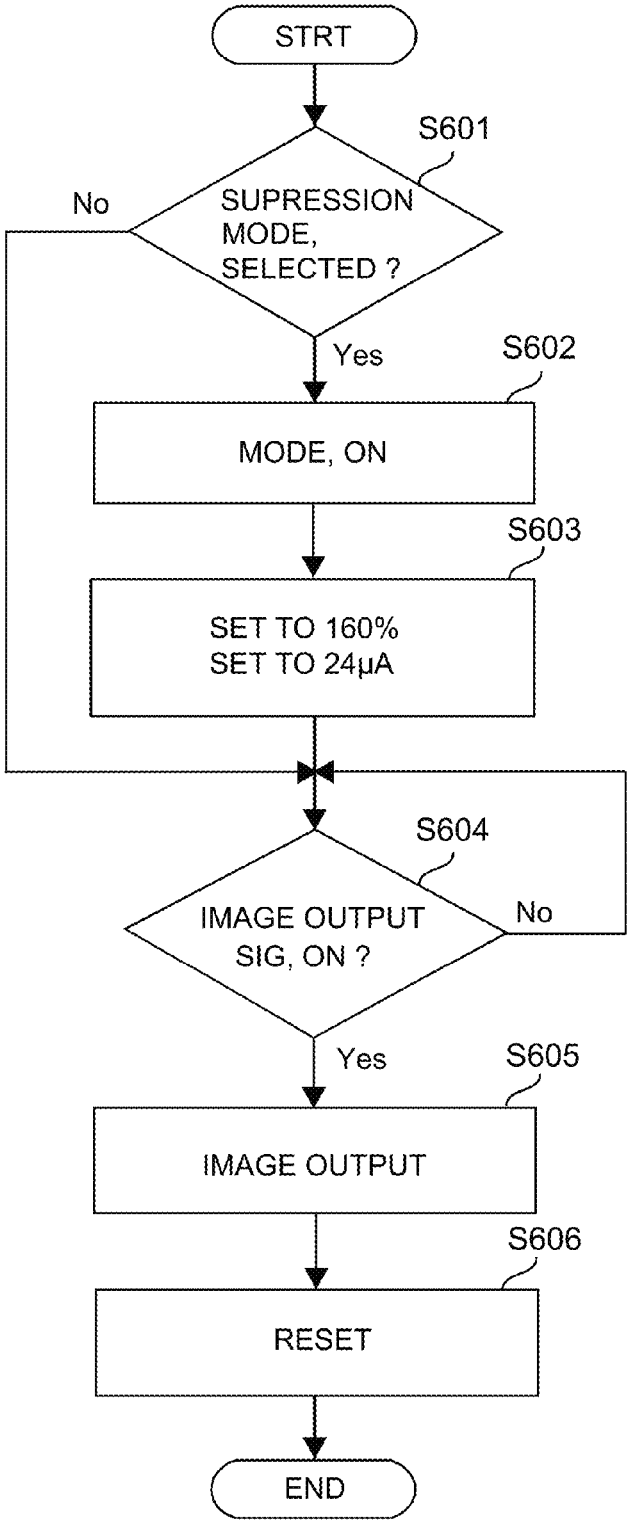
FIG. 9 is a flowchart for describing the operational sequence of the image forming apparatus in the third embodiment of the present invention.

FIG. 9 is a flowchart for describing the operation of the image forming apparatus 100 in this embodiment. FIG. 9 shows the operational sequence followed by the controlling section 120 of the image forming apparatus 100 in this embodiment. The operational sequence to be followed by a user, and the operational sequence followed by the printer driver 312, are the same as those in the above described second embodiment, which are shown in part (a) of FIGS. 8 and 8(*b*), respectively.

Referring to FIG. 9, as the controlling section 120 of the image forming apparatus 100 receives a signal for turning on a transfer ghost suppression mode (S601), it sets the image forming apparatus 100 in a transfer ghost suppression mode only for the current job (S602). Then, the controlling section 120 ignores the settings of the image forming apparatus 100, and sets the maximum amount of toners for the secondary color to 160%, and the primary transfer current amount for the downstream stations S to 24 μA (S603). Thereafter, as an image outputting operation start signal is inputted from the PC 300 (S604), the controlling section 120 makes the image forming apparatus 100 carry out the image outputting operation (S605). Further, as the job is completed, the controlling section 120 sets the maximum amount of toners for the secondary color, and the primary transfer current amount, back to those prior to the starting of the completed job (S606).

As described above, not only can this embodiment provide the same effects as the first embodiment, but also, can provide the following effect. That is, in this embodiment, the printer driver 312 is prioritized over the image forming apparatus 100 in terms of the setting of operational mode related to a transfer ghost. That is, the operational mode, in which the image forming apparatus 100 is, is ignored, and the operational mode for the image forming apparatus 100 is automatically switched to a transfer ghost suppression mode which is temporarily set by the printer driver 312 (maximum amount of toners for secondary color is reduced from normal setting, and primary transfer current amount for downstream stations S is increased from normal setting). Thus, this embodiment makes it possible to operate the image forming apparatus 100 in a transfer ghost suppression mode only for the users who want to suppress the occurrence of a transfer ghost, and for the images which are likely to trigger the occurrence of a transfer ghost, without the need for repeating complicated operations for setting the image forming apparatus 100, while preventing the current setting of a transfer ghost suppression mode from affecting other users and/or images.

[Miscellanies]

In the foregoing, the present invention was described with reference to some of the preferred embodiments of the present invention. However, these embodiments are not intended to limit the present invention in scope.

For example, the preceding embodiments were described with reference to an image forming apparatus which forms four monochromatic toner images of yellow (Y), magenta (M), cyan (C) and black (K) colors, one for one, to effect a single multicolor (full-color) image. However, these embodiment were not intended to limit the present invention in terms of the number of toner colors and toner types. For example, the present invention is also applicable to image forming apparatuses which form only three monochromatic toner images, that is, yellow (Y), magenta (M) and cyan (C) toner images, to form a full-color (multicolor) image, and image forming apparatuses which form four monochromatic toner images of yellow (Y), magenta (M), cyan (C) and black (K) colors, one for one, and additional monochromatic toner images (including transparent image) which are different in color from these monochromatic toner images, in place of these images, to form a full-color (multicolor) image. Also in the case of such image forming apparatuses, the occurrence of a transfer ghost can be suppressed as it was in the preceding embodiment, by reducing the upstream stations S in the maximum amount of toners for the secondary color, and increasing the downstream stations in the primary transfer current amount.

Further, the preceding embodiments were described with reference to an image forming apparatus which forms yellow (M), magenta (M), cyan (C) and black (K) monochromatic toner images, in the listed order. However, these embodiments are not intended to limit the present invention in scope in terms of the order in which these monochromatic toner images are formed. For example, in the preceding embodiments, the primary transfer current amount was increased only for the stations SC and SK, to the primary transferring section of which the monochromatic images of primary color, which effect the secondary color, are conveyed from the upstream stations S. However, in the case of an image forming apparatus which forms monochromatic toner images in the order of yellow (Y), cyan (C), magenta (M) and black (K) toner images, it is the stations SM and SK, or the third and fourth stations, respectively, that have to be increased in the primary transfer current amount.

Moreover, the preceding embodiments were described with reference to an image forming apparatus of the so-called intermediary transfer type, that is, an image forming apparatus having an intermediary transferring member as the first transfer medium. However, the present invention is also applicable to an image forming apparatus of the so-called direct transfer type, which has a recording medium bearing member which bears and conveys a sheet of recording medium, in place of the intermediary transferring member in the preceding embodiments. As a recording medium bearing member, a recording medium bearing belt, which is similar in structure to the intermediary transferring member in the preceding embodiments, is used. In the case of an image forming apparatus which uses a recording medium bearing member, monochromatic toner images, different in color, are sequentially transferred in layers on to a sheet of recording medium on the recording medium bearing belt, from the photosensitive drums 1, in the four stations S, by the function of the transfer rollers, which are similar to the primary transfer rollers in the preceding embodiments, one for one. Therefore, the toner images are fixed to the sheet of recording medium on the recording medium bearing belt, and then, the sheet of recording medium is discharged from the main assembly of the image forming apparatus. Also in the case of this type of image forming apparatus, the above described issue related to a transfer ghost, which is similar to those mentioned in the description of the preceding embodiment, will possibly occur. Therefore, even in the case of this type of image forming apparatus, the same effects as those obtainable by these preceding embodiments can be obtained by applying the present invention to the image forming apparatus, that is, by operating the apparatus in a transfer ghost suppression mode which is similar to those in the preceding embodiments.

Moreover, in the preceding embodiments, the information processing peripheral device which outputs to the image forming apparatus, the information about the image to be formed, and the information about the settings for an image outputting operation, was a personal computer. However, these embodiments are not intended to limit the present invention in terms of the information processing peripheral device. As other information processing peripheral devices, a computer of the tablet type, a smart phone, a portable telephone, a digital camera, a scanner, etc., can be listed.

Further, regarding the setting for the transfer current amount, the preceding embodiments were described with reference to a case in which the image forming apparatus was operated in an environment which was normal in temperature and humidity. However, some image forming apparatuses are varied in the setting for the transfer current amount, according to environmental condition, for example, whether they are operated in an environment which is low, normal, or higher in temperature and humidity. Even the image forming apparatus 100 in the preceding embodiments can be adjusted in the setting for the transfer current amount (from normal setting, including setting for transfer ghost suppression mode) according to environmental condition. Even in such a case, all that is necessary when an image forming apparatus is in the transfer ghost suppression mode is to set the image forming apparatus 100 smaller in the maximum amount of toners for the secondary color than the normal setting (default setting), and set the downstream stations higher in the primary transfer current amount than the normal setting (default setting), even if the environmental condition remains the same.

Further, in the transfer ghost suppression mode, an image forming apparatus may be controlled so that the setting for the maximum amount of toners for the secondary color is reduced compared to the current setting (as referential setting), and the setting for the primary transfer current amount is increased compared to the current setting (as referential setting). In the case where a user turns on the transfer ghost suppression mode after the user confirmed the presence of a transfer ghost in the outputted images, it is sometimes possible obtain good results by using the current setting as the referential setting for the adjustment.

The preceding embodiments were described with reference to a case where the transfer bias is controlled so that the transfer current remains stable at a preset level during an image forming operation. In such a case, as the transfer bias is applied, the areas of the peripheral surface of the photosensitive drum, which have the secondary colors, and those which do not have the secondary color, are likely to become different in potential level from each other. Therefore, the present invention is extremely effective. However, these embodiments are not intended to limit the present invention in scope. That is, even in a case where the transfer bias is controlled so that the transfer current remains stable at a preset level, and yet, a transfer ghost occurs as in the preceding embodiments, it is possible to obtain the same effects as those obtained in the preceding embodiments, by applying the present invention.

Moreover, in the preceding embodiments, in the transfer ghost suppression mode, only specific image forming sections (stations) among the multiple image forming sections aligned in the moving direction of transfer medium (recording medium), were increased in transfer current compared to the referential value. Further, the specific image forming sections are the third and fourth image forming sections among the four image forming sections, that is, one of the image forming sections which are not the first and second ones, for the following reason. That is, a transfer ghost is a phenomenon that occurs in the downstream image forming sections as described above. Further, as the transfer current is increased, image defects (coarseness, and the like) other than a transfer ghost sometimes occur. However, in a case where the intensity of the above described other image defects is at a tolerable level, it is possible to increase all the image forming sections in the amount of transfer current. With the use of these tactics, it is possible to simplify an image forming apparatus 100 in control, and/or to deal with an image forming apparatus, all the image forming sections of which share the same transfer current power source.

Further, as described above, the present invention is extremely effective to suppress the occurrence of such a transfer ghost that occurs to the images formed in the downstream image forming stations of an image forming apparatus of the so-called tandem type, and also, is attributable to the toner images of the secondary color, which are formed on a transfer medium (or recording medium) in the upstream image forming sections (stations). In comparison, as has been well known in the filed of image forming apparatuses, there are image forming apparatuses which have only a single photosensitive member and form a full-color (multicolor) image on a transfer medium (recording medium) by repeatedly transferring toner images in layers onto the transfer medium (intermediary transferring member, or sheet of recording medium borne by recording medium bearing member). Also in the case of such image forming apparatuses, there occurs that the area of the peripheral surface of the photosensitive member, which has just passed through the transferring section, is recharged to form a toner image, while the toner image of the secondary color, which was borne on the transferring member and has just been conveyed to the transferring section, is still in the transferring section, and the transferring means is supplied with transfer current. Also in such a case, it is possible that a transfer ghost which is similar to the above described transfer ghost which occurs to an image forming apparatus of the so-called tandem type, will occur to the image formed on a sheet of recording medium during the next rotation of the photosensitive member. Therefore, even in the case of these image forming apparatuses, the same effects as those obtainable by the preceding embodiments can be obtained by operating the image forming apparatuses in the transfer ghost suppression mode in accordance with the present invention, in which the amount by which toners are borne by the transferring member to form a toner image of the secondary color is reduced, and the transfer current to be supplied to the transferring section is increased. In this case, it is possible to increase only the transfer current for the transferring process for transferring an image of the third color and thereafter, in the transfer ghost suppression mode. Moreover, as has been widely known in the field of image forming apparatuses, there are image forming apparatuses which have only a single photosensitive member, form in layers multiple toner images on the single photosensitive member, and then, transferred the multiple toner images onto a sheet of recording medium all at once. Also in the case of these image forming apparatuses, there occurs that the area of the peripheral surface of the photosensitive member, which has just passed through the transferring section, is recharged to form a toner image, while the toner image of the secondary color, which was borne on the transferring member and has just been conveyed to the transferring section is still in the transferring section, and the transferring means is supplied with transfer current. Also in such a case, it is possible that a transfer ghost which is similar to the above described transfer ghost which occurs to an image forming apparatus of the so-called tandem type, will occur to the image formed on the photosensitive member during the next rotation of the photosensitive member. Therefore, even in the case of these image forming apparatuses, the same effects as those obtainable by the preceding embodiments can be obtained by operating these image forming apparatuses in a transfer ghost suppression mode in accordance with the present invention, in which the amount, by which toners are borne by the peripheral surface of the photosensitive member to form a toner image of the secondary color, is reduced, and the transfer current to be supplied to the transferring section is increased.

The present invention can be embodied in the form of a system, an apparatus (device), a method, a program, and/or storage medium. More concretely, the present invention is applicable to a system made up of two or more devices. It is also applicable to an apparatus made up of only a single device. By the way, the present invention includes cases where a system or an apparatus is directly or remotely supplied with a software (program) for enabling the system or apparatus to perform the functions such as those performed by the system and apparatuses in the preceding embodiments, and the system or the computer of the apparatus reads the supplied program codes, and operates according to the program codes. That is, the program codes themselves which are installed in the computer of an apparatus to make the apparatus to operate in a transfer ghost suppression mode in accordance with the present invention are also embodiments of the present invention. In other words, the present invention includes computer programs for making an apparatus operate in accordance with the present invention. As for the storage medium for supplying the programs, there are a hard disk, an optical disk, a magneto-optical disk, a nonvolatile memory, and the like, for example. Further, as a method for supplying programs, it is possible to list such a method as downloading computer program files (which include compressed ones which are automatically installed) into a storage medium such as a hard disk, from a home page. Further, not only can the above described functions in the preceding embodiments be realized as the computer makes the system or apparatus carry out the read program. That is, the present invention is embodied as an OS or the like, which operates on a computer, carries out a part (parts) or the entirety of the process based on the instruction read by the computer. Further, it sometimes occurs that a program read from a storage medium is written in a memory with which a function expansion board (daughter board) inserted in a computer, or in a function expansion unit which is in connection to a computer, is provided. In such a case, the present invention is embodied (realized) by a part (parts) or the entirety of the process which a CPU or the like with which the function expansion board or function expansion unit carries out based on the instruction of the written program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-148282 filed on Jul. 18, 2014, which is hereby incorporated by reference herein in its entirety.

What is claimed is:

1. An image forming apparatus comprising:

a movable intermediary transfer member;

first to third toner image forming units arranged in the listed order along a moving direction of said intermediary transfer member from an upstream side toward a downstream side with respect to the moving direction and configured to sequentially form different color toner images on said intermediary transfer member, said first toner image forming unit for forming a first toner image and including a first photosensitive member and a first exposure member configured to form an electrostatic latent image by exposing said first photosensitive member to light with a predetermined exposure amount, said second toner image forming unit for forming a second toner image and including a second photosensitive member and a second exposure member configured to form an electrostatic latent image by exposing said second photosensitive member to light with a predetermined exposure amount, and said third toner image forming unit for forming a third toner image and including a third photosensitive member, a charging member configured to be supplied with a voltage having only a DC component to charge said third photosensitive member in a charge portion, a transfer member configured to form a transfer portion between said third photosensitive member and said transfer member with said intermediary transfer member therebetween;

a voltage source configured to apply a voltage to said transfer member to form in the transfer portion an electric field for transferring the third toner image formed on said third photosensitive member onto said intermediary transfer member while passing the first toner image and the second toner image;

an execution portion configured to execute an image forming operation for forming an image on a recording material by transferring altogether the toner images sequentially formed on said intermediary transfer member by said first to third toner image forming units;

an input portion configured to input an image adjustment setting, the image adjustment setting including a first setting and a second setting; and a control portion configured to set, when the first setting is inputted, a transferring current to a first current and the exposure amounts of said first and second exposure members so as to provide a first maximum toner deposition amount during the execution of the image forming operation by said execution portion, and said control portion being configured to set, when the second setting is inputted, the transferring current to a second current which is greater than the first current and the exposure amounts of said first and second exposure members so as to provide a second maximum toner deposition amount which is smaller than the first maximum toner deposition amount during the execution of the image forming operation by said execution portion.

2. The apparatus according to claim 1, wherein said control portion sets initially the image adjustment setting to the first setting, and when said input portion inputs the second setting, said control portion sets the image adjustment setting to the second setting, and the image forming operation executed after the second setting is inputted is executed with the second setting.

3. The apparatus according to claim 1, wherein said control portion initially sets the image adjustment setting to the first setting, and when said input portion inputs the second setting, said control portion sets the image adjustment setting to the second setting, and only the image forming operation first executed after the second setting is inputted is executed with the second setting, and wherein after completion of the first execution of the image forming operation, said control portion resets the image adjustment setting to the first setting.

4. The apparatus according to claim 1, wherein said input portion includes the operating portion for inputting information relating to the image adjustment setting.

5. The apparatus according to claim 1, wherein said input portion receives information relating to the image adjustment setting from external terminal equipment.

6. The apparatus according to claim 1, wherein said input portion includes an operating portion for inputting information relating to the image adjustment setting, and said input portion receives information relating to the image adjustment setting from external terminal equipment, wherein said control portion sets the image adjustment setting with a preference given to the input from the external terminal equipment.

* * * * *